US009081369B1

(12) United States Patent
Kaelin et al.

(10) Patent No.: US 9,081,369 B1
(45) Date of Patent: Jul. 14, 2015

(54) MODULAR MECHANICAL TIMEPIECE UNIT WITH FUNCTIONAL MODULES

(71) Applicant: ETA SA Manufacture Horlogere Suisse, Grenchen (CH)

(72) Inventors: Laurent Kaelin, Sonvilier (CH); Jean-Bernard Peters, Pieterlen (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 14/634,260

(22) Filed: Feb. 27, 2015

Related U.S. Application Data

(63) Continuation of application No. 13/711,125, filed on Dec. 11, 2012.

(30) Foreign Application Priority Data

Dec. 13, 2011 (EP) ..... 11193173

(51) Int. Cl.
*G04D 3/00* (2006.01)
*G04B 29/00* (2006.01)

(52) U.S. Cl.
CPC *G04D 3/00* (2013.01); *G04B 29/00* (2013.01); *Y10S 901/47* (2013.01)

(58) Field of Classification Search
CPC ..... G04B 29/00; G04D 3/00; Y10S 901/47
See application file for complete search history.

(56) References Cited

U.S. PATENT DOCUMENTS

| | | | | |
|---|---|---|---|---|
| 7,302,758 | B2 * | 12/2007 | Kaelin et al. | 29/876 |
| 2002/0064097 | A1 * | 5/2002 | Wyssbrod | 368/88 |
| 2005/0050718 | A1 * | 3/2005 | Kaelin et al. | 29/622 |
| 2008/0112273 | A1 | 5/2008 | Pellaton | |

(Continued)

FOREIGN PATENT DOCUMENTS

| | | | |
|---|---|---|---|
| CH | 647 125 G | A3 | 1/1985 |
| EP | 0 862 098 | A2 | 9/1998 |

(Continued)

OTHER PUBLICATIONS

European Search Report issued Aug. 15,2012 in corresponding European Application No. 11 19 3173 filed on Dec. 13, 2011 (with an English Translation).

*Primary Examiner* — Vit W Miska
(74) *Attorney, Agent, or Firm* — Oblon, McClelland, Maier & Neustadt, L.L.P.

(57) ABSTRACT

A method for assembling a mechanical modular unit includes storing in a controller a list of assembly parts of the unit. The method includes irreversibly transforming a sub-assembly of each functional module into a ready to use functional module, after adjustment and function checking of a particular timepiece function have been performed on a test bench. The method includes storing in a storage place components required for the assembly list. The method includes programming a manipulator controlled by the controller to look, in a pre-defined sequence peculiar to each assembly list, for each component or module to be assembled. The method includes programming a shape recognition part to operate the manipulator to pick up each functional module according to a locating part included therein, to arrange the module in an assembly position. The method includes each time, irreversibly assembling precisely arranged elements of the mechanical modular unit to each other.

6 Claims, 5 Drawing Sheets

(56) References Cited

U.S. PATENT DOCUMENTS

| | | | | |
|---|---|---|---|---|
| 2010/0278018 | A1 | 11/2010 | Jouvenot | |
| 2011/0110199 | A1 | 5/2011 | Girardin et al. | |
| 2013/0016590 | A1* | 1/2013 | Moulin et al. | 368/127 |
| 2014/0211596 | A1* | 7/2014 | Kaelin et al. | 368/142 |

FOREIGN PATENT DOCUMENTS

| | | | |
|---|---|---|---|
| EP | 1 079 284 | A1 | 2/2001 |
| EP | 1 211 578 | A1 | 6/2002 |
| WO | WO 2009/056498 | A1 | 5/2009 |

* cited by examiner

MODULAR MECHANICAL TIMEPIECE UNIT WITH FUNCTIONAL MODULES

CROSS REFERENCE TO RELATED APPLICATIONS

This application is a divisional of U.S. application Ser. No. 13/711,125, filed on Dec. 11, 2012, and is based upon and claims the benefit of priority from European Patent Application No. 11193173.9 filed Dec. 13, 2011, the entire contents of each of which are incorporated herein by reference.

FIELD OF THE INVENTION

The invention concerns a functional timepiece module that can be integrated in a mechanical modular unit, wherein said functional module is a mechanical module derived from a sub-assembly comprising a rigid bridge carrying the components required to perform a particular timepiece function of transforming a movement between at least one input wheel set and at least one output wheel set.

The invention further concerns a mechanical modular unit for a timepiece movement or timepiece comprising a plurality of said functional modules.

The invention also concerns a method of assembling a mechanical modular unit of this type.

The invention also concerns a timepiece movement including at least one such mechanical modular unit.

The invention also concerns a timepiece comprising at least one mechanical modular unit of this type.

The invention concerns the field of mechanical horology and more specifically the field of watches.

BACKGROUND OF THE INVENTION

Modular timepieces are known. Although very widely known in electronic horology, they are less frequent in mechanical horology, where construction in modules, generally devised to break down the same basic movement into several calibres with different functions or having a different presentation, is usually more expensive than the traditional method of manufacture. Only a few additional mechanisms, made on additional plates, are relatively widespread.

Modular construction conventionally imposes the constraint of machining high precision interfaces, because of the accumulation of assembly clearances between modules, which require very tight tolerances for each module, to ensure a satisfactory result for the entire unit.

Manufacture in modules is also very often detrimental to the total thickness of the movement, and it is difficult to make ultra flat or even simply flat movements.

However, modular construction remains an interesting objective for timepiece manufacturers, since it allows assembling tasks to be split. In return for the tighter manufacturing tolerances required by the accumulation of clearances between modules, the final assembly operation can be carried out by less skilled personnel because it is less complicated. However, the final assembly operation still requires the knowledge and sensitivity of a watchmaker.

EP Patent Application No. 1 079 284 in the name of ETA discloses a watch with two main modules each of which contains half of the components.

EP Patent Application No. 0 862 098 in the name of VOSS discloses a modular watch with a timing mechanism forming an entire module.

EP Patent Application No 1 211 578 in the name of ETA discloses an ultra thin electromechanical movement with stacked modules, implementing tubular elements compensating for the variations in thickness of the assembly elements.

WO Patent Application No. 2009/056498 A1 in the name of JOUVENOT FREDERIC discloses an additional self winding mechanism wherein the veil of the oscillating weight is mounted between the main set of hands on the one hand, and the chronograph and off-centre seconds hands on the other. This additional mechanism is not a module, since it is sandwiched between the components of the main movement, and various arbours and pipes of the movement pass through it.

CH Patent Application No. 647 125 A3 in the name of DUBOIS & DEPRAZ SA discloses a chronograph with a motor module, which includes a first power take-off integral with the cannon-pinion thereof and a second power take-off integral with the seconds arbour. A chronograph module is removably mounted and the gear train thereof is driven by the second power take-off. The two power take-offs are concentric and accessible from the same side of the motor module. The chronograph module is secured between the dial and the top face of the motor module. The hands form part of the chronograph module.

US Patent Application No. 2008/112 273 A1 in the name of PELLATON LOÏC (ETA SA) discloses a movement with a fixed support fitted with a display module comprising a central bar secured to the support and an annular display member which rotates freely about the central bar, abutting on the fixed support. The display member has a contact surface. The central bar includes three positioning surfaces formed by three protruding portions cooperating with said contact surface to position the display member axially on the fixed support. The central bar includes three assembling surfaces which are axially and angularly shifted relative to the positioning surfaces. The display member has three lugs. The contact surface, the positioning surfaces, the assembling surfaces and the lugs are arranged to form together a bayonet assembly system for mounting the display member on the bar.

US Patent Application No. 2011/110 199 A1 in the name of GIRARDIN FREDERIC discloses a module for actuating one element of a movement, intended to be mounted on a movement frame. This module contains a mechanism comprising a pivoting control stem moving between axial positions, a control pinion rotatably integral with the control stem, and at least one actuation member arranged to cooperate with the control pinion in one of the axial positions of the stem. The control pinion is integral in translation with the stem when the latter moves from one axial position to another. The module comprises an independent case containing the mechanism, and a connecting means which comes out of the case and is arranged to kinematically connect the actuating member to the element of the movement to be actuated, so that the actuating member can actuate said element regardless of the position of the module on the movement frame.

SUMMARY OF THE INVENTION

The invention proposes to overcome certain prior art problems by proposing a mechanical modular unit which can be assembled without using an operator, while ensuring the exactitude of working parameters with tried and tested adjustments, and with a lower production cost than that of a traditional method of manufacture.

The invention therefore concerns a functional timepiece module that can be integrated in a mechanical modular unit, said functional module being derived from a sub-assembly comprising a rigid bridge carrying components required to perform a particular timepiece function of transforming a movement between at least one input wheel set and at least one output wheel set, characterized in that said sub-assembly is autonomous and includes all the components necessary for performing said particular timepiece function as a result of said input wheel set being set in motion by a means external to said module, further characterized in that said sub-assembly includes adjustment and/or assembly components which are irreversibly secured after the adjustment and function checking of said particular timepiece function have been performed on the test bench on said individual sub-assembly, and in that said module, which is derived from the transformation of said sub-assembly by the irreversible securing of said adjustment and/or assembly components, includes at least a first bearing surface and a locating means for recognising and positioning said module relative to another element of a said mechanical modular unit, or relative to a plate, by the abutment of said first bearing surface on a complementary bearing surface comprised in said other element or said plate.

The invention further concerns a mechanical modular unit for a timepiece movement or timepiece comprising a plurality of such functional modules, characterized in that each of said functional modules is irreversibly adjusted by the irreversible securing of said adjustment and/or assembly components thereof and in that said functional modules cooperate in abutment in pairs or each in abutment with a plate or a bridge comprised in said mechanical modular unit, on a first bearing surface of each said functional module.

The invention further concerns a method of assembling a mechanical modular unit of this type wherein:

- a list of assembly parts of said mechanical modular unit, including at least one functional module for each particular timepiece function required by said mechanical modular unit, the assembly sequence of said mechanical modular unit, the relative assembly positions between components of said list and, for each component, an instruction relating to a loose hold or irreversibly fixed hold, are stored in a control means,
- for each said functional module, a sub-assembly of each said functional module is irreversibly transformed into a ready to use functional module, after adjustment and function checking of said particular timepiece function have been performed on the test bench.
- the components required for the assembly list of said mechanical modular unit is stored in a storage place, including at least one functional module for each particular timepiece function required by said mechanical modular unit, each said functional module being already irreversibly adjusted after adjustment and function checking of said particular timepiece function have been performed on the test bench.
- a manipulator controlled by control means is programmed to look, in a pre-defined sequence peculiar to each said assembly list of said mechanical modular unit, for each said component or functional module to be assembled.
- a shape recognition means is programmed to operate said manipulator to pick up each said functional module according to the locating means comprised therein, so as to arrange said module in the assembly position with another said functional module or with said plate or with a bridge of said mechanical modular unit, in a precise position set by said control means according to data gathered by said shape recognition means.
- each time the precisely arranged elements of said mechanical modular unit are irreversibly assembled to each other.

The invention also concerns a timepiece movement including at least one such mechanical modular unit.

The invention also concerns a timepiece comprising at least one mechanical modular unit of this type.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
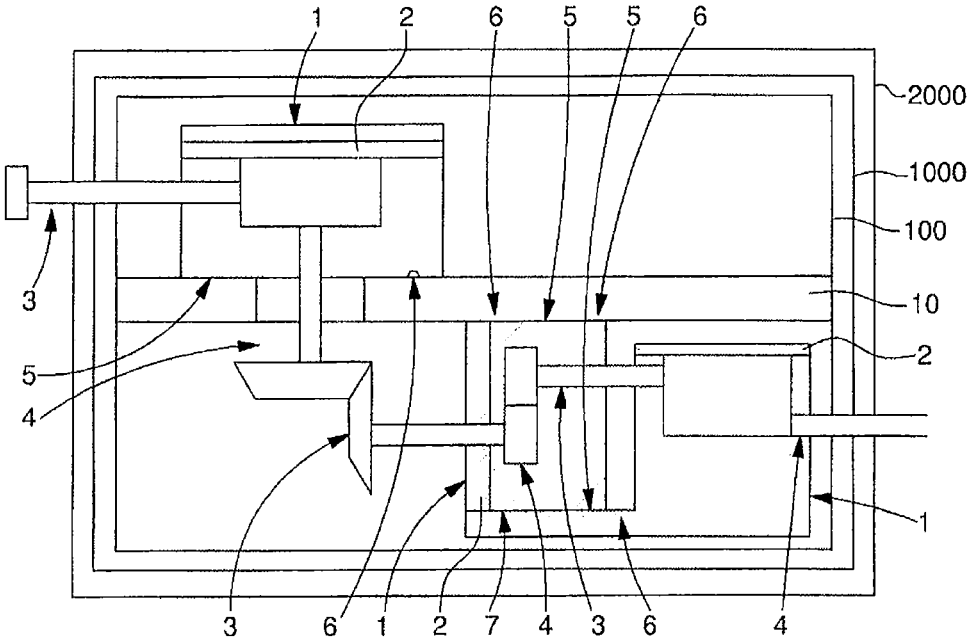
FIG. 1 shows schematic block diagrams of a timepiece with a movement including a mechanical modular unit according to the invention, which in turn comprises several functional modules according to the invention.
Figure 3:
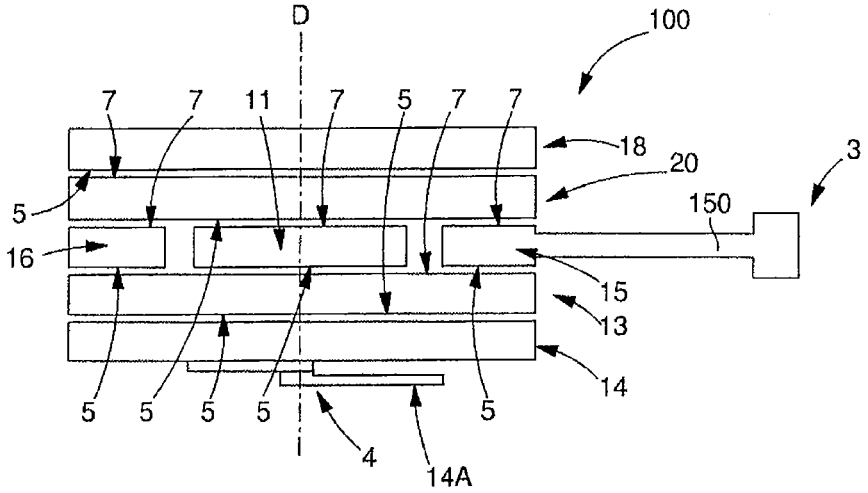
FIG. 3 shows a schematic, partial, exploded side view of a mechanical modular unit according to the invention, combining several functional modules according to the invention.
Figure 2:
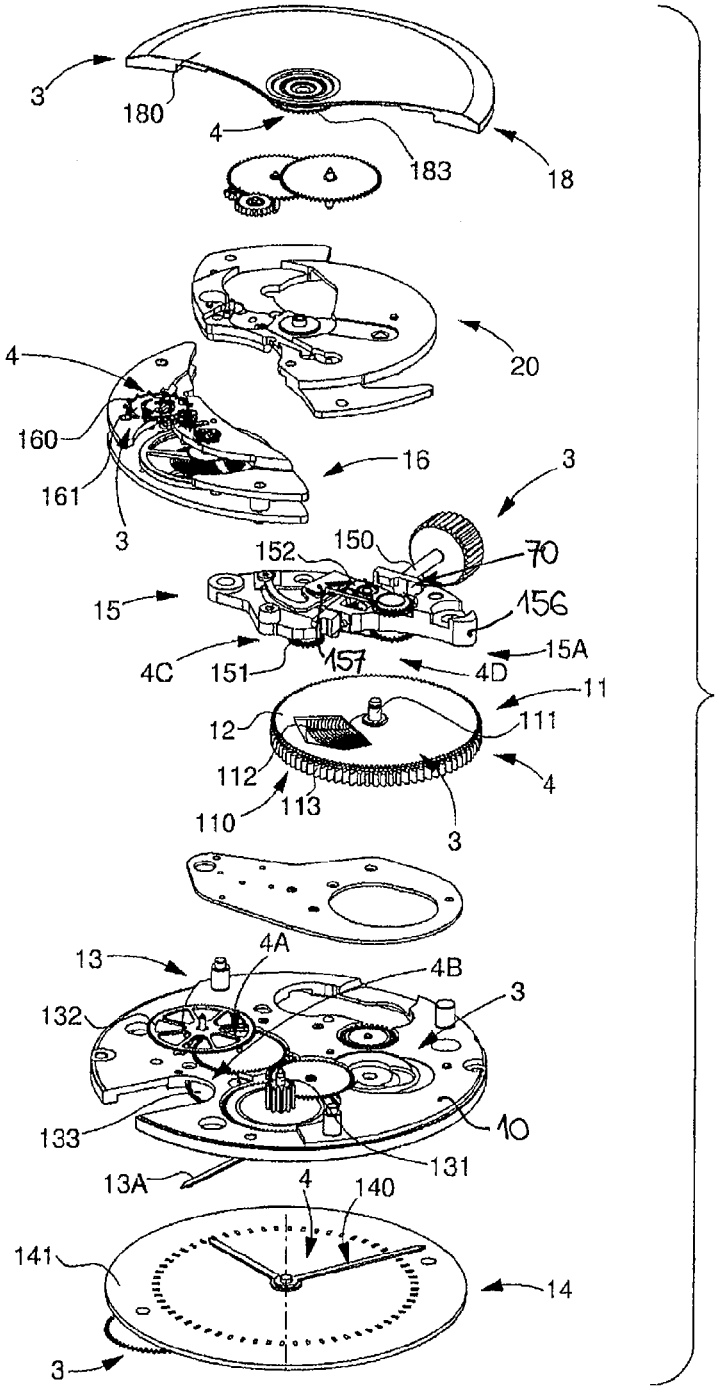
FIG. 2 shows a partial, schematic exploded view of a timepiece comprising a timepiece movement formed by a mechanical modular unit according to the invention, combining several functional modules of the invention, with some modules being shown transparently or with parts removed.

The invention concerns the field of mechanical horology and more specifically the field of watches.

The invention concerns both a functional timepiece module 1 that can be integrated in a mechanical modular unit 100 and a mechanical modular unit 100 formed in a particular manner with said modules 1, possibly completed with other components.

Functional module 1 according to the invention is a mechanical module derived from a sub-assembly 1A. This sub-assembly 1A includes a rigid bridge 2 carrying components required to perform a particular timepiece function of transforming a movement between at least one input wheel set 3 and at least one output wheel set 4.

According to the invention, this sub-assembly 1A is autonomous and includes all of the components required to perform said particular timepiece function, as a result of input wheel set 3 being set in motion by means external to module 1.

According to the invention, this sub-assembly 1A includes adjustment and/or assembly components 9 which are irreversibly fixed after the adjustment and function checking of the particular timepiece function have been performed on the test bench on this individual sub-assembly 1A.

Figure 4:
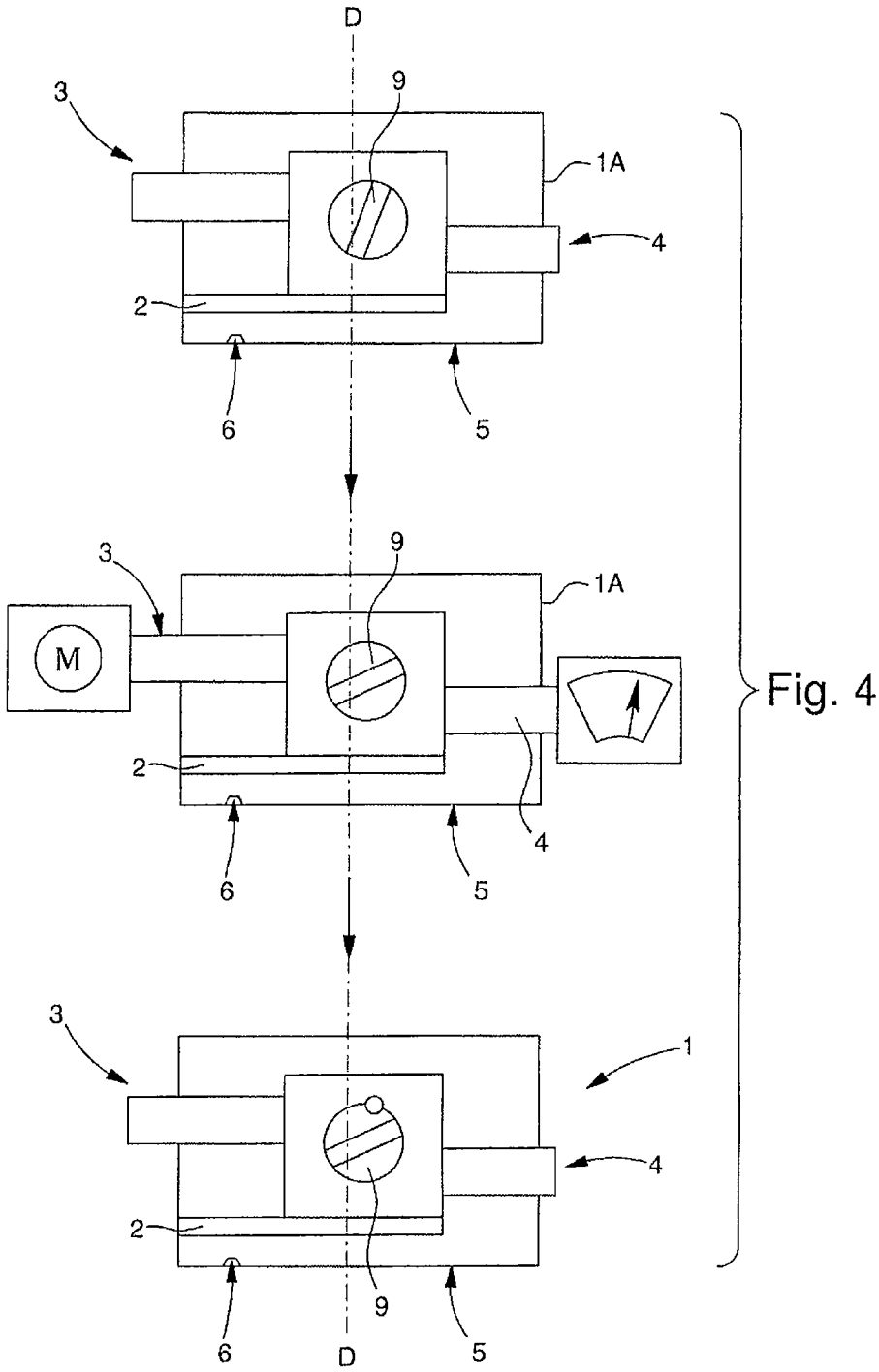
FIG. 4 shows a schematic view of three successive steps of the transformation of a sub-assembly which is assembled in the first view, then checked and adjusted in the second view, and then irreversibly transformed into a functional module according to the invention in the third view in which the adjustments are permanently fixed.

The actual functional module 1 is a pre-adjusted module derived from the transformation of a sub-assembly 1A of this type, by the irreversible securing of its adjustment and/or assembly components 9. FIG. 4 illustrates an example transformation of a sub-assembly 1A into a pre-adjusted functional module 1, by securing a securing screw 9 to a case or similar, by a punch mark or laser microweld or similar.

The combination of pre-adjusted functional modules 1 is an essential aspect of the invention since each function corresponding to a particular module is therefore tested as early as possible and at lower cost. Adjustments are performed once and for all for each module. Irreversibly securing the adjustment components 9 in each module 1 ensures that the previously performed adjustments in each stored module 1 do not deteriorate over time. Management of the final assembly operation is simplified since the final assembly list comprises fewer components.

This module 1 includes at least a first bearing surface 5 and a locating means 6 for recognising and positioning module 1 relative to another element of a mechanical modular unit 100 of this type, or relative to a plate comprised in said unit 100, in abutment via the first bearing surface 5 on a complementary bearing surface comprised in said other element or said plate.

The notion of a "bearing surface" is understood in the broadest sense. A "bearing surface" may equally well be formed by a bore or arbour, or a flat surface or other element.

The locating means may be devised to locate with or without contact, and may take several forms, which may be combined with each other:

- in an advantageous variant for automated manufacture, the locating means 6 includes an optical locating means for the optical recognition and positioning of module 1,
- in another variant, the locating means 6 includes contactless locating means of the inductive, capacitive, acoustic or ultrasound type for the recognition and positioning of module 1;
- in another variant or, more advantageously in addition to any of the preceding variants, locating means 6 includes a mechanical locating means for the mechanical recognition and positioning of module 1, such as sensors, stop members or suchlike.

In a preferred embodiment, the first bearing surface 5 is flat and perpendicular to a direction of insertion D.

Preferably, functional module 1 includes at least a second bearing surface 7 parallel to the first bearing surface 5. This arrangement facilitates automated assembly by paraxial positioning relative to direction of insertion D, with certain components or modules stacked with their bearing surfaces perpendicular to the direction of insertion D in contact with each other.

Advantageously, to ensure certain cooperation between assembly components, in particular gearings between toothed wheels, or between wheels or racks, ratchets or suchlike, or to ensure the positioning of cams, jumper springs, clicks, finger, pushers or suchlike, functional module 1 includes at least one pivot guide means 8 to allow the module to be pre-assembled while allowing it a degree of freedom to pivot. It is therefore possible to ensure this cooperation in a final pivoting movement of module 1. In a preferred but non-limiting embodiment, this pivotal guiding occurs relative to a parallel direction to said direction of insertion D, especially when achieved in accordance with the features of EP Patent Application No. 11005713 by the same Applicant.

In a variant, module 1 includes a guide means arranged to cooperate with a complementary guide means comprised in another module 1, or a component of mechanical modular unit 100 or a plate of said unit, to achieve a similar cooperation by translation, or a parallel adjustment, in one plane. Preferably, this guide means is made in a perpendicular direction to direction of insertion D.

A first type of functional module 10 is a motor module 11 and it comprises at least one barrel 110, whose input wheel set is formed by a barrel arbour 111, which cooperates with a ratchet 12, which may or may not be incorporated in said motor module 11, and which is arranged to be pivoted, either by a manual winding mechanism or by a winding and time-setting mechanism 15, or by a self-winding mechanism or by a self-winding module 18, to wind at least one spring 112 in at least one drum 113 forming the output wheel set 4 of said motor module 11. This drum 113 is arranged for driving an input pinion 131 of a gear train or a gear train module 13.

Another type of functional module 1 is a gear train module 13, the input wheel set 3 of which is formed by an input pinion 131 arranged to cooperate with a drum 113, and a first output wheel set 4A of which is formed by a fourth wheel 132 arranged to cooperate with an escape pinion 161 connected to an escape wheel 160 comprised in an escape mechanism or a regulating module 16.

Advantageously, functional module 1 and in particular gear train module 13, includes a second output wheel set 4B which is formed by a display train 133 arranged to cooperate, either with a display means 13A of train module 13, or with a display module 14 external to train module 13, comprising a display means 14A.

Thus, yet another type of functional module 1 is a display module 14, the input wheel set 3 of which is formed by a display train 133 comprised in a gear train mechanism or gear train module 13, and the output wheel set 4 of which is formed by at least one indicator 140 arranged to cooperate with a complementary indicator 141 or with a dial comprised either in display module 14 or in a timepiece which incorporates said module.

Advantageously, this gear train module 13 or display module 14 includes the motion work mechanism, which is friction connected to the gear train disclosed in EP Patent Application No. 11177840 by the same Applicant, and includes a fourth wheel set pre-assembled on a centre tube, which is the subject of EP Patent Application No. 11177839 by the same Applicant.

Yet another type of functional module 1 is a time-setting module 15, the input wheel set 3 of which is formed by a stem 150 arranged to be moved by a user, and a first output wheel set 4C of which is formed by a motion work control train 151.

Preferably, this time-setting module 15 is also a time-setting and winding module 15A, and includes a second output wheel set 4D which is formed by a winding control train 152.

Advantageously, this module 15 is made with a winding stem mechanism according to EP Patent Application No. 11170180 by the same Applicant. It may also integrate a device for manual winding via pressure on the stem according to EP Patent Application No. 11177838 by the same Applicant.

In a particular embodiment, this module 15 is based on a bridge made of plastic material, preferably highly resistant charged plastic, for example 30% or 40% polyphenylene sulfide (PPS), or a polyamide such as polylauromide (PA 12), and with a maximum thickness of close to 2.5 mm, the choice of these materials ensuring that good rigidity is maintained even with large section differences in said bridge 15.

This stem mechanism module 15 is devised for robotic assembly and testing. Studs are driven onto a bridge and advantageously pass through said bridge and project from both sides thereof. Wheels, levers, the sliding gear and pull-out piece are mounted on said studs; and an optical check with a camera is performed on a first part of the train, comprising in particular a sliding gear for selecting between two wheels, one controlling the time-setting function and the other the winding function, before said first part of the train is permanently confined by a holding plate, preferably achieved by laser welding the covering plate, at several points, either just below the surface at the end of the studs acting as pivot arbours, or through the covering plate. This irreversible assembly means that the assembly can be turned over by a manipulator in complete safety in order to assemble components on the other side, which is checked by a camera, before the lever holding plate is set in place, welded in several places. The kinematic chain starting from stem 150 is then completed, and a mechanical function check is performed in the three positions T1, T2, T3 of the stem, in both directions of rotation. As disclosed in EP Patent Application No. 11170180 cited above, module 15 advantageously comprises a pivoting lever for holding the stem. The operation of said lever is mechanically tested by provisionally pulling out the stem, but this is saved until the final assembling of the movement.

Yet another type of functional module 1 is a regulating module 16 comprising a regulating unit, and the input wheel set 3 of which is formed by an escape wheel 160 arranged to be moved by a fourth wheel 132 comprised in a gear train or gear train module 13, and the output wheel set 4 of which is formed by said same escape wheel 160.

This platform escapement regulating module 16 is advantageously made in accordance with the characteristics of EP Patent Application Nos. 11005713 and 11179181 by the same Applicant. This regulating module 16 advantageously includes, for the external securing of the balance spring, a stud bonded to a bar, the width of said stud being sufficient to all it to be identified until said stud is permanently bonded. Advantageously, this regulating module 16 includes a balance with a small mould casted roller according to EP Patent Application No. 11194061.5 by the same Applicant. The assembly of this regulating module 16 includes optical camera checks, and inter-axe and distance measurements, before the module is permanently adjusted and secured. A clamp type gripping means allowing said regulating module 16 to be held in place so that it can be turned over for several weld spots to be made on the side which is not visible to the watch user.

A particular functional module 1 is a self-winding module 18, the input wheel set 3 of which is formed by an oscillating weight 180 moved by the motions of a user or by an external tool, and the output wheel set 4 of which is formed by a drive train 183 of a ratchet 12 comprised either in a motor mechanism, or a motor module 11, or a ratchet 12 which meshes with a barrel arbour comprised either in a motor mechanism or a motor module 11.

This oscillating weight 180 is advantageously made in accordance with the characteristics of EP Patent Application No. 11188261 by the same Applicant.

In an embodiment specific to the invention, except for its input wheel set 3 and/or its output wheel set 4, functional module 1 is comprised within two parallel planes, which form a first plane bearing surface 5 perpendicular to a direction of insertion D and a second bearing surface 7. It is therefore easy to juxtapose the functional modules 1 thereby formed by stacking them like cards in a set of cards. Naturally, if an input wheel set 3 and/or an output wheel set 4 projects from the module, a cut or passage is made in the adjacent modules to allow for cooperation and stacking.

Locating means 6 for recognising and positioning module 1 can take various forms. Preferably, it is formed by one or more marks created during the machining of certain components of the module, and in particular on a first flat bearing surface 5 and a second bearing surface 7. Particularly for components which are made by bar turning, the locating means may form a centring groove, and in a similar manner for components made in a machining centre, the locating means may consist in milled grooves or shoulders which are inexpensive to make and easily identified by a camera. This locating means may also consist of silk screen printing or similar.

In a particular embodiment, functional module 1 may also have, on at least one of the components thereof, at least one female machined portion such as a bore, and/or at least one male machined portion such as a journal or a boss, made with broad tolerance, enabling the module to be easily stored on a storage pallet, or held on a conveyor belt, or held in any similar manner necessary for handling the module during the assembly cycle of a mechanical modular unit 100 incorporating module 1.

Advantageously, these machined portions are made inexpensively with tolerances that have no relation to horological adjustments, of around 0.05 to 0.10 mm or more. In a particular embodiment where two adjacent modules 1 in a mechanical modular unit 100 are arranged in this manner, one with a female machined portion and the other with a male machined portion, it may be advantageous to combine them during assembly, not for precise centring which is not possible with their respective tolerances, but to irreversibly secure them to each other, by bonding, welding, brazing, heading or another method, the clearance between the female machined portion and the male machined portion being chosen to be around 0.05 to 0.10 mm or more, and being utilised to insert adhesive, braze or suchlike. At least one of the female machined portion and the male machined portion may also form a tank of sacrificial material for local transformation, for example a journal can be melted locally to form a weld with a bore with which it cooperates.

In a particular variant, the pre-adjustment of functional module 1 takes account of the assembly stresses with other modules or components forming the larger unit.

In particular, a functional module 1 may have a prestress on a bridge or suchlike.

In an advantageous variant, a functional module 1 includes a support made of highly resistant charged plastic material, for example PPS 30 or PPS 40 or similar, in order to withstand the high traction stresses which may be exerted on certain arbours. To answer the same resistance requirement, the functional module components are mounted on through-hole metal pins driven into the support, rather than studs moulded with the support, whose shearing resistance might be insufficient. These components are then immobilised, on a first side, by welding onto a first end of said pins. The advantage of using this type of support is the accessibility from both sides for assembling components. During automated assembly, it is possible to turn over the support at an intermediate assembly stage, after the components have been assembled on one side, and it is then easy to mount the components on the second side and immobilise them by welding the second end of each pin. Naturally, it is then possible to turn over the support as many times as desired since there is no risk of losing any components.

It is clear that the modular configuration according to the invention specifically allows two sided accessibility relative to an intermediate support, which is not possible in a conventional assembly where all the components are mounted on the same side of a plate, which cannot be turned over as work is carried out. It can even be said that the modular configuration is mandatory in order for this assembly and double sided welding to be carried out.

In a preferred variant, movement 100 includes a maximum of one screw, on the oscillating weight 180, if the movement has one. All the other connections are achieved without using screws.

In a particular variant without an oscillating weight, movement 100 has no screws at all.

Limiting the number of screws or omitting screws is an important factor in preventing maladjustment or failure.

The invention further concerns a mechanical modular unit 100 of this type for a timepiece movement 1000 or a timepiece 2000 comprising a plurality of functional modules.

According to the invention, this mechanical modular unit 100 includes a plurality of these defined functional modules 1.

In a first embodiment, at least one of the functional modules 1 is irreversibly adjusted by the irreversible securing of its adjustment and/or assembly components 9, after checking and adjustment on the test bench intended to provide said module with quite specific operating parameters.

In another embodiment, each of the functional modules 1 is irreversibly adjusted by the irreversible securing of its adjustment and/or assembly components 9, after checking and adjustment on the test bench intended to provide said module with quite specific operating parameters.

These functional modules 1 cooperate in abutment in pairs, or each in abutment with a plate 10 or with a bridge comprised in said mechanical modular unit 100, on a first bearing surface 5 of each functional module 1.

In a particular embodiment, this mechanical modular unit 100 is assembled with all the functional modules 1 comprised therein irreversibly assembled to each other.

The composition of mechanical modular unit 100 according to the invention deliberately moves away from traditional timepiece architectures where components are assembled one after the other on a plate, and where the operation of the movement is tested last, which means that all the adjustments are carried out at the end, often involving partial dismantling to carry out the final alteration and then adjustment operations.

Irreversibly securing functional modules 1 to each other or to the same plate 10 also goes against conventional timepiece embodiments. Modular unit 100 according to the invention is not intended to be removable for after-sales requirements. Indeed, it is irreversibly assembled, which ensures that the adjustments made will last over time, both as regards each of the functional modules and the complete assembled mechanical modular unit 100. The purpose of securing modules 1 is precisely to prevent any loosening and relative movement between components, which often cause failure during use. Thus, the design prevents failures and mechanical modular unit 100 cannot be dismantled once it is completely irreversibly assembled.

In an advantageous embodiment, each irreversibly pre-adjusted functional module secured to plate 10 or to another said pre-adjusted functional module 1 is a mechanical module.

Figure 5:
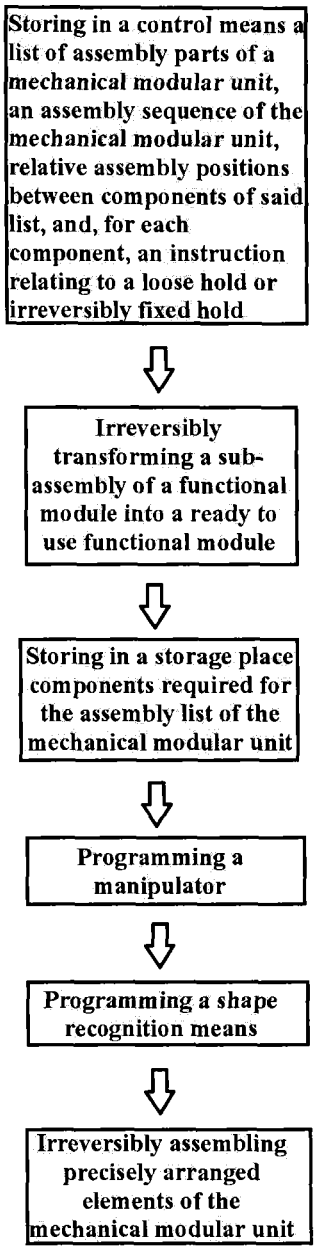
FIG. 5 shows a method for assembling a mechanical modular unit according to one non-limiting illustrative embodiment of the invention.
Figure 6:
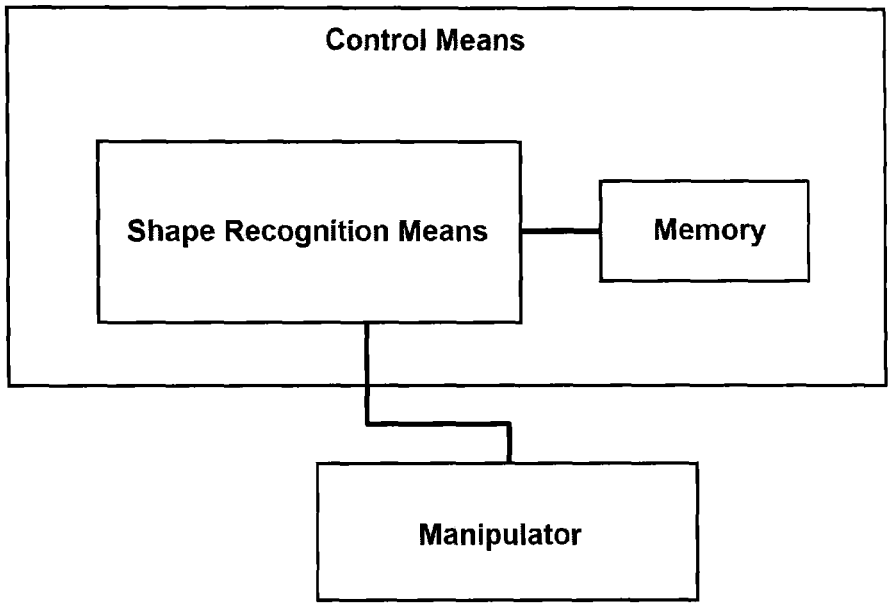
FIG. 6 shows a schematic block diagram of a control means that controls a manipulator according to one non-limiting illustrative embodiment of the invention.

As shown in FIG. 5 for example, the invention also concerns the method of assembling this type of mechanical modular unit 100 wherein:

there is stored in a control means, as shown in FIG. 6 for example, a list of assembly parts of said mechanical modular unit 100, including at least one functional module 1 for each particular timepiece function required by said mechanical modular unit 100, the assembly sequence of said mechanical modular unit 100, the relative assembly positions between components of said list and an instruction regarding the loose hold or irreversibly fixed hold of each component, for each said functional module 1, a sub-assembly 1A of each said functional module 1 is irreversibly transformed into a ready to use functional module 1, after an adjustment and function check of the particular timepiece function that said particular functional module 1 has to perform, are carried out on the test bench.

the components required for the assembly list of said mechanical modular unit 100 are stored in a storage place, including at least one functional module 1 for each particular timepiece function required by said mechanical modular unit 100, each said functional module 1 being already irreversibly adjusted after the adjustment and function checking of said particular timepiece function have been performed on the test bench. It is thus clear that all the components and modules 1 which form the mechanical modular unit 100 are ready for use and no longer require either alteration or adjustment;

a manipulator, controlled by a control means, is programmed to look, in a pre-defined sequence peculiar to each said assembly list of said mechanical modular unit 100, for each said component or functional module 1 to be assembled;

a shape recognition means is programmed to operate said manipulator to pick up each said functional module 1 according to the locating means 6 comprised therein, so as to arrange said module in the assembly position with another said functional module 1 or with said plate 10 or with a bridge of said mechanical modular unit 100, in a precise position set by said control means according to data gathered by said shape recognition means;

each time the precisely arranged elements of said mechanical modular unit 100 are irreversibly assembled to each other. This irreversible assembly does not allow for any subsequent dismantling. It can be performed by bonding, welding, brazing, rivets, heading or other means.

Preferably, a memory, which includes the shape of each of the components and/or modules 1 required for the assembly list of said mechanical modular unit 100, is incorporated in the control means. The shape recognition means is programmed to operate the manipulator to pick up each component and/or module 1 according to its stored shape, so as to arrange it in an assembly position relative to a functional module 1 or relative to a component of unit 100, or relative to plate 10 or relative to a bridge comprised in mechanical modular unit 100, to hold said component during handling in a precise position set by the control means according to data gathered by the shape recognition means. Depending on the instruction set out in the list as regards loose hold or irreversibly fixed hold, the component is either irreversibly assembled during handling into position on the sub-assembly of mechanical modular unit 100 as it is being made, or the component is left loose during handling before its degree of freedom is reduced by positioning and securing other components subsequently named on the list in the assembly sequence.

Thus, preferably, each functional module 1 is held irreversibly fixed, either sandwiched between other components, or trapped in a sealed case, or held immobile, by an irreversible securing method or a welding method or a bonding method or another method ensuring that the module cannot be dismantled relative to another component or relative to another functional module 1 or relative to plate 10 or relative to a bridge comprised in mechanical modular unit 100.

Preferably, during preparation of the components on the list prior to the storage of functional modules 1, on at least one and preferably on each functional module 1, a first flat bearing surface 5 is made perpendicular to a direction of insertion D and at least a second bearing surface 7 parallel to the first bearing surface 5.

Also, during assembly of functional module 1 in mechanical modular unit 100, said module is arranged in the assembly position with another functional module 1 or plate 10 or a bridge comprised in said mechanical modular unit 100, on flat surfaces on both sides, and in a precise position set by the control means according to data gathered by the shape recognition means.

Preferably, all the movements of translation of the manipulator are controlled to insert components and/or modules 1 in a parallel direction to a single direction of insertion D.

Preferably, the shape recognition means used comprises optical locating means for the optical recognition and positioning of each module 1.

Movement 100 comprising these functional modules 1 is assembled in accordance with the same principle. Thus, the assembling of some components of the movement includes similar test and irreversible securing steps prior to use. This is particularly the case of the assembling of the gear train on plate 10, which, once irreversibly fixed by welding, forms a gear train module.

The automated assembly of the gear train starts with preparation of plate 10 by the etching, preferably laser etching, therein of the identifying marks required for after-sales service, anti-counterfeiting marks, and the traceable manufacturing code of the movement. A centre tube is prepared on a specific stand, the plate is placed and driven onto a shoulder of said centre tube and riveted thereto; a fourth arbour is prepared on a stand, the preceding sub-assembly is placed on the fourth arbour, and the pinion is then placed on the top and driven onto the fourth arbour to secure it. The centre wheel is then positioned, the combination of a camera, a rotating manipulator and a positioning robot then enables the third wheel to be positioned and a similar handling operation is performed to position the intermediate plate and any other wheels in the correct gearing. A holding plate for said gear train is then welded in several places. Any necessary oiling is carried out during the assembly process in accordance with specific manufacturing rules, and in sufficient quantity to allow a mechanical function test of the gear train to be carried out by mechanical and/or fluid driving.

The invention also concerns a timepiece movement 1000 including at least one such mechanical modular unit 100.

In a particular preferred embodiment, movement 100 does not contain an index-assembly where the balance spring is secured. Indeed, adjusting the rate by direct mechanical action on the balance means that this mechanism is no longer required. Consequently, no shock absorber is required to hold a non-existent index-assembly, which allows greater freedom as regards the design of the damping means.

Advantageously, movement 100 includes top and bottom cylindrical shock absorbers which are simple, inexpensive and compact.

The invention also concerns a timepiece 2000 including at least one such mechanical modular unit 100.

The invention has the advantage of combining, in a mechanical modular unit, functional modules, which have each been pre-adjusted and pre-tested, and which do not require any subsequent adjustment during the final assembly of the mechanical modular unit. The reliability of a unit of this type is therefore very good.

The invention also optimises the internal volume of the movement, by allowing flat movements to be made, which was not possible in prior art embodiments comprising additional mechanisms each comprising a plate stacked on other plates and onto the bottom plate.

The choice of a design oriented towards automated final assembly guided by shape recognition means allows for broader tolerances regarding the dimensions of the inter-module interfaces. However, the quality of the bearing surfaces at these interfaces must be impeccable, in particular as regards flatness when, in a preferred manner, these bearing surfaces are flat surfaces.

The invention claimed is:

1. A method for assembling a mechanical modular unit, comprising:

storing in a control means a list of assembly parts of said mechanical modular unit, including at least one functional module for each particular timepiece function required by said mechanical modular unit, an assembly sequence of said mechanical modular unit, relative assembly positions between components of said list and, for each component, an instruction relating to a loose hold or irreversibly fixed hold;

irreversibly transforming a sub-assembly of each said functional module into a ready to use functional module, after adjustment and function checking of said particular timepiece function have been performed on a test bench;

storing in a storage place the components required for the assembly list of said mechanical modular unit, including at least one functional module for each particular timepiece function required by said mechanical modular unit, each being a pre-adjusted functional module being already irreversibly adjusted after the adjustment and function checking of said particular timepiece function have been performed on the test bench;

programming a manipulator controlled by the control means to look, in a pre-defined sequence peculiar to each said assembly list of said mechanical modular unit, for each said component or functional module to be assembled;

programming a shape recognition means to operate said manipulator to pick up each said functional module according to locating means comprised therein, so as to arrange said functional module in an assembly position with another said functional module or with a plate or with a bridge of said mechanical modular unit, in a precise position set by said control means according to data gathered by said shape recognition means; and each time, irreversibly assembling the precisely arranged elements of said mechanical modular unit to each other.

2. The method of assembling a mechanical modular unit according to claim 1, wherein a memory including a shape of each of said components required by said assembly list for said mechanical modular unit is incorporated in said control means, and further comprising:

programming said shape recognition means to operate said manipulator to pick up each said component according to said stored shape thereof, so as to arrange said component in an assembly position relative to said functional module or relative to said plate or relative to said bridge comprised in said mechanical modular unit, to hold said component in a precise position set by said control means according to data gathered by said shape recognition means, and, according to said instruction relating to the loose hold or irreversibly fixed hold, irreversibly fixing said component in position on the sub-assembly of said mechanical modular unit at an implementation stage or leaving loose said component before a degree of freedom thereof is reduced by a positioning and securing of other components subsequently named on said assembly list.

3. The method of assembling a mechanical modular unit according to claim 1, further comprising:

irreversibly fixedly holding each said functional module, either sandwiched between other components, or trapped in a sealed case, or held immobile by an irreversible securing method, or a welding method, or a bonding method, relative to another component or relative to another said functional module or relative to said plate or relative to said bridge comprised in said mechanical modular unit.

4. The method of assembling a mechanical modular unit according to claim 1, further comprising:

prior to the storing of said functional modules, making on each said functional module a first flat bearing surface, perpendicular to a direction of insertion, and at least a second bearing surface parallel to said first bearing surface, and, during assembly of said functional module in said mechanical modular unit, arranging said functional module in an assembly position with another said functional module or with said plate or with said bridge comprised in said mechanical modular unit, on flat surfaces on both sides, and in a precise position set by said control means according to the data gathered by said shape recognition means.

5. The method of assembling a mechanical modular unit according to claim 1, further comprising:

operating all movements of translation of said manipulator in a single direction of insertion.

6. The method of assembling a mechanical modular unit according to claim 1, wherein the shape recognition means comprises optical locating means for optical recognition and positioning of each said functional module.

* * * * *